United States Patent [19]

Fink, Jr.

[11] Patent Number: 4,809,753

[45] Date of Patent: Mar. 7, 1989

[54] ATTITUDE CONTROL DEVICE FOR FUEL DISPENSING NOZZLE

[75] Inventor: Arthur C. Fink, Jr., Franklin, Mo.

[73] Assignee: Husky Corporation, Pacific, Mo.

[21] Appl. No.: 757,914

[22] Filed: Jul. 22, 1985

Related U.S. Application Data

[63] Continuation of Ser. No. 521,983, Aug. 11, 1983, abandoned.

[51] Int. Cl.[4] ..... B65B 1/30

[52] U.S. Cl. ..... 141/206

[58] Field of Search ..... 137/38, 39, 43, 533.11; 141/192, 206, 207, 208, 392; 200/153 A; 222/52, 481.5, 500

[56] References Cited

U.S. PATENT DOCUMENTS

| | | | |
|---|---|---|---|
| 841,474 | 1/1907 | Wendelken | 137/533.11 X |
| 2,335,346 | 11/1943 | McGee | 141/207 |
| 2,874,735 | 2/1959 | Boone | 141/208 |
| 3,186,605 | 6/1965 | Potoczky | 222/500 X |
| 3,318,482 | 5/1967 | Voce | 222/500 X |
| 3,521,679 | 7/1970 | Copony | 141/208 |
| 3,794,202 | 2/1974 | Unger | 222/500 X |
| 4,108,223 | 8/1978 | Hansel | 141/392 |

FOREIGN PATENT DOCUMENTS

| | | | |
|---|---|---|---|
| 727639 | 4/1955 | United Kingdom | 141/206 |

*Primary Examiner*—Henry J. Recla

*Attorney, Agent, or Firm*—Paul M. Derk

[57] ABSTRACT

An attitude control device for use in combination with a fuel dispensing nozzle, incorporating a connector that secures to the normally disposed vent tube provided within the spout of such a nozzle, the connector contains passages therein for venting of any nozzle generated vacuum to the atmosphere, but incorporates a cylinder held ball valve which when seats upon a valve seat, provided within the connector, functions to prevent any further venting of any generated vacuum, and immediately initiates a shut off of the fuel dispensing nozzle, and curtails any further flow of fuel through the same.

5 Claims, 1 Drawing Sheet

ATTITUDE CONTROL DEVICE FOR FUEL DISPENSING NOZZLE

This application is a continuation of the application having Ser. No. 521,983, filed on Aug. 11, 1983, and now abandoned.

BACKGROUND OF THE INVENTION

This invention relates generally to the dispensing of fuel, and more specifically to the regulation of fuel flow so as to curtail the same when fuel dispensing has ceased, the nozzle has been removed from the fuel tank, and the further flow of any fuel should logically be immediately shut off as a result thereof. The automatic fuel dispensing nozzles that are currently and presently used for the dispensing of gasoline, gasohol, diesel fuels, and the like, at the full service or self service type of stations, are generally of the type of nozzle that automatically shut off when the tank is full, or should the nozzle be mishandled, dropped, or otherwise misplaced. Ordinarily, such nozzles, when they have been opened and held in other fuel dispensing position by means of the setting of a clip, as is known in the trade, will not automatically shut off when simply hand held, laid down, or even hung up on the side of the dispensing pump. This presents a potentially very hazardous situation in the dispensing of fuel, if an automatic nozzle should be picked up or unseated from its location within the gas pump, and particularly if the nozzle has been left in the open fuel flow position, the hazard substantially being encountered when the pump is once again turned on for initiating fuel flow, resulting in fuel being immediately dispensed, regardless whether the nozzle be located within the tank, or at any other direction. Furthermore, this particular problem becomes very serious in the self service style of gasoline station, of the prepay type, because, usually, and particularly where a specified amount of fuel has been paid for, and the dispenser has been set to automatically shut off dispensing at a particular level, the pump may shut off before the nozzle is released, or the release lever and its clip may still be set to maintain the nozzle in the opened position, with the customer believing that the nozzle's valves have now been closed, and that further dispensing of fuel cannot take place. When such a condition prevails, the previous customer will simply relocate the nozzle back into the gasoline dispenser housing. Then, when the next person arrives, to purchase and obtain a supply of fuel, and may pick up the nozzle in preparation for fuel dispensing, turn the pump on, as by manipulating the standard switch provided upon the dispenser housing, gasoline will once again inadvertently be dispensed in all directions, in abundance, and spray gasoline all over the customer, any bystander, in addition onto the vehicle and upon the ground. Thus, the hazards previously alluded to become rather apparent.

As is known in the trade, the automatic shut off of a fuel dispensing nozzle is achieved generally by the development of a vacuum generated through the rapid flow of fuel through the nozzle, creating a vacuum at the location of venturi that leads towards a secondary chamber, in which a diaphragm is located, but that the vacuum that would ordinarily develop within the secondary valve chamber is normally relieved through the location of a vent tube interiorly along the length of the nozzle spout, and which opens to atmosphere approximate the tip of the said spout. Thus, any vacuum created within the aforesaid chamber is normally vented, but at such time when the fuel begins to fill the gasoline tank, and its heavy vapors develop pressure or the fuel itself reaches the end of the vent tube, this closes off any further escape passage for the developing vacuum, and thereby allows such a vacuum to be created within that defined chamber, thereby allowing the secondary valve to become initiated, and effecting an immediate shut off of the fuel dispensing nozzle. Ordinarily, the vacuum from this chamber is vented to atmosphere near the tip end of the fuel dispensing spout, by means of that vent tube arranged interiorly of the spout, as connected to the inner spout wall, and the port that opens exteriorly of the nozzle spout prevents any vacuum from becoming strong enough to cause the nozzle to shut off, under ordinary operating conditions, unless that port becomes obstructed by something such as the rising level of fuel of the fuel being filled. When the port in the vent tube tip is obstructed, as by fuel, the vacuum increases causing the diaphragm to move and the nozzle to shut off. Examples of this state of the art providing for the installation of vent tubes within nozzle spouts, and their effect upon a diaphragm for achieving nozzle shutoff, as when the tank is filling, can be seen in select prior patents obtained by the inventor's assignee herein, as disclosed in the U.S. Pat. Nos. 4,016,910, and 4,031,930.

The current invention capitalizes upon the principal of operation of that vent tube within a fuel dispensing nozzle, modifies it through the addition of a valve means to its end, or approximate end, in order to achieve a closure of the vent tube when the nozzle is angulated into particular directions, such as when being removed from a gasoline tank, or being removed from a gasoline fuel pump cabinet, in order to insure that the nozzle is properly shut off, and to prevent that untimely dispensing of fuel which can cause the type of hazardous conditions as previously described.

It is, therefore, the principal object of this invention to provide an attitude control device employed in conjunction with the vent tube of a dispensing nozzle, and which functions to automatically shut off the operations of a fuel nozzle, or to prevent its dispensing of fuel, simply due to the achievement of a particular angulation in the handling of the nozzle during application.

A further object of this invention is to provide an attitude control device mounted onto the end of a gasoline nozzle vent tube and which when raised above the horizontal, automatically shuts off the internal operating valves of a dispensing nozzle, to assure that no further fuel will be dispensed, even in the event that the gasoline pump should once again be turned on.

Another object of this invention is to provide an attitude control device mounted to the end of a vent tube of a nozzle spout and which when angulated essentially below the horizontal, allows for the free operation of the nozzle for dispensing a quantity of fuel to the gasoline tank, or the like.

Another object of this invention is to provide an attitude control device that may be particularly arranged in conjunction with the vent tube of a gasoline nozzle, and be angulated at select degrees for attaining operations of its ball check valve located therein, so as to either allow the nozzle to dispense, or to curtail its operations, depending upon the angulated orientation of the spout nozzle during its handling.

Still another object of this invention is to provide a fail-safe type of control means for use in conjunction with a gasoline nozzle and that ordinarily will prevent the malfunctioning of a fuel nozzle during its usage.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the addition of a control means to a gasoline or other fuel dispensing nozzle, and for the purposes previously described, to prevent the untimely discharge of fuel when such is not desired. The invention essentially relates to the addition cf a connector means to the end of the vent tube normally located with the nozzle spout, and through which the flowing fuel normally is discharged, with the connector means incorporating valve means in the nature of a ball check valve, which normally is actuated into its opening or closed positions through the gravity movement of the ball valve located therein. The connector means normally incorporates a passage way therethrough, for communicating with the internal channel normally provided through the dispenser spout tube, and which connector means passage also vents the interior of the tube exteriorly of the spout, but at the same time, incorporates another leg of the connector passage for mounting a cylinder thereto, and in which the ball valve normally locates for its movements between the opening of the attitude control device, or checking of its opening by seating of the ball valve upon a valve seat located within the associated connector means. The connector means, and its valve containing cylinder are mounted at the approximate end of the said vent tube, as previously explained, it also functions to anchor the vent tube at its forward end to the inside of the spout, and in addition, it provides a port for the vacuum generated within the functioning nozzle to the exterior of the spout and thereby provides for normal fuel dispensing, but at the same time, is ready to sense the level of fuel flowing into the gasoline tank, such as of an automobile or other vehicle, and function to immediately shut off when fuel reaches the level of the vapor sensitive vent tube. This valve means does provide attitude control for the dispensing nozzle, such that when the nozzle may be elevated above the horizontal, or at some other predetermined degree, the ball valve will shift rearwardly within its cylinder and seat upon the connector means vent seat, to thereby close off the vent tube, and immediately initiate a shut off of the nozzle operations, or in the alternative, as the nozzle is tilted downwardly, and the ball valve unseats from its specified valve seat, the nozzle will be in condition for convenient dispensing of fuel once the pump is again turned on. In any event, an attitude control device constructed in the manner of this invention eliminates the previously described type of hazards that have occurred in the dispensing of fuel at the service stations, and particularly where such predicaments occur rather routinely at those stations catering to the self service dispensing of gasoline, or other fuel.

BRIEF DESCRIPTION OF THE DRAWINGS

In referring to the drawings, FIG. 1 provides a sectional view of the frontal portion of a dispensing nozzle, and its nozzle spout, also disclosing the arrangement of its vent tube therein, and the attitude control device of this invention.

DESCRIPTION OF THE PREFERRED EMBODIMENT

Figure 1:
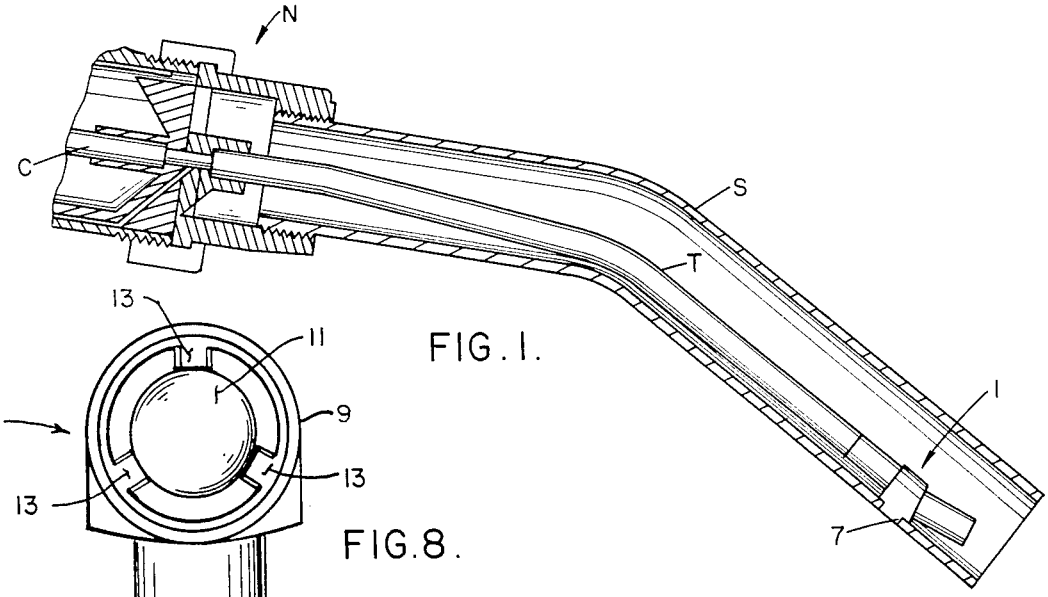
Figure 2:
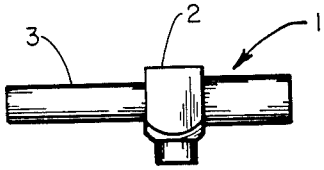
FIG. 2 provides a side view of one embodiment of the attitude control device of this invention.
Figure 3:
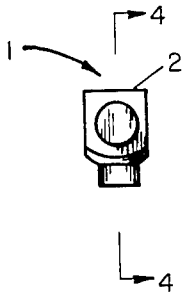
FIG. 3 provides a front view of the device shown in FIG. 2.
Figure 4:
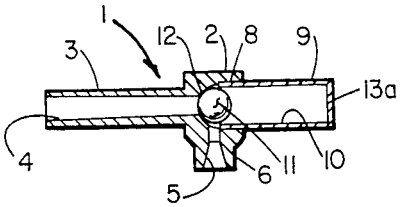
FIG. 4 provides a sectional view of the attitude control device taken along the line 4—4 of FIG. 3.

In referring to FIG. 1, there is disclosed the sectional view, as previously explained, of the front portion of a dispensing nozzle end, having its spout S extending forwardly thereof, and which is normally inserted into the gasoline tank during fuel dispensing, with the spout having a vent tube T arranged interiorly thereof, and which mounts at its back end to conduit means C that leads to the diaphragm chamber of a dispensing nozzle for providing and initiating automatic shutoff of the nozzle as when fuel reaches a filled level within the tank to which it is being added. As previously explained, this normally occurs when the fuel closes off the open opposite end of the vent tube T, thereby curtailing the path through which the vacuum generated within the diaphragm chamber of the nozzle normally obtains its venting to atmosphere. As also can be seen, connecting with the end of the vent tube T is the attitude control device 1 of this invention. This device, as also shown in the additional FIGS. 2 through 7, may be formed to various designs, but as disclosed in FIGS. 2 through 4, one embodiment is shown comprising a connector means 2, which includes a rearly extending chamber 3 which is secured onto the frontal end of the vent tube T, as by any means of fastening, as known in the trade. For example, the chamber 3 may insert within the open end of the vent tube T, or slide over the end, or perhaps have a connecting sleeve arranged interiorly of each of these components for holding the two into fixed position, as shown in FIG. 1. In any event, the interior passage of the vent tube T communicates with another passage, as at 4, provided through the connector means 2, and the passage 4 communicates with a vent port 5 extending downwardly of the connector means, and which normally is secured, as along its tapering shoulder 6, through an opening, as at 7, provided through the nozzle spout S. The passage further extends through the connector means 2, as at 8, and mounted thereto is a cylinder 9 having an opening 10 provided therein, and in which a ball valve 11 may freely travel, from one end of the cylinder 9 to the other, and for purposes to be subsequently described. For example, when the ball valve 11 is at the location as shown in FIG. 4, meaning that the nozzle spout S will be arranged extending substantially upwardly, above the horizontal, the ball valve 11 will seat upon the valve seat 12, thereby shutting off the opening of the passage 4, in addition to any chamber provided through the vent tube T, which means that vacuum will cease to be vented to the atmosphere, and will trigger other mechanisms for automatically shutting off the nozzle from its dispensing condition. This operation is rather clearly defined in the two previously cited patents that describe this prior art type of structure as embodied within fuel dispensing nozzle. But, when the nozzle is tilted downwardly, so that its spout S tilts below the horizontal, then the ball valve 11 will roll forwardly within the cylinder 9, and towards its front wall, as at 13*a*, thereby opening the passage 4, and allowing the previously generated vacuum to be vented through the connector means passage 5 to the atmosphere, thereby allowing the nozzle to function properly for dispensing of further fuel.

Figure 5:
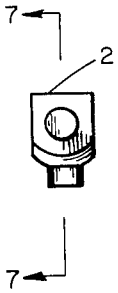
FIG. 5 provides a front view of the style of attitude control device shown mounted in conjunction with the vent tube of the nozzle disclosed in FIG. 1.
Figure 6:
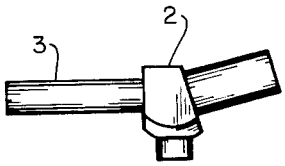
FIG. 6 provides a side view of the device shown in FIG. 5.
Figure 7:
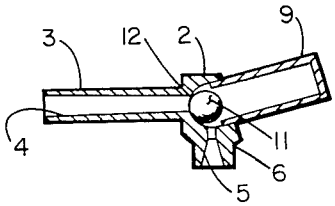
FIG. 7 provides a sectional view of the attitude control device taken along the line 7—7 of FIG. 5.

Obviously, upon considering the structure of the previously defined attitude control device of this invention, the alignment of the cylinder 9, with respect to the chamber 3, and its locating within the nozzle spout S, becomes rather critical. For example, the angulation of the cylinder 9, for allowing the ball valve 11 to freely move therein, controls just when said ball check valve shall attain closure upon its seat 12, and automatically effect a shut-off of the dispensin nozzle. Hence, as can be seen in FIGS. 5 through 7, the style of attitude control device as employed in the nozzle end disclosed in FIG. 1 is shown. In this particular embodiment, the various features of the connector means 2 are generally the same, wherein its chamber 3 incorporates a passage 4, communicating with another passage 5 for venting of any generated vacuum to the atmosphere. And, the shoulder 6 of the connector means 2 is provided for tightly fastening through the aperature 7, provided proximate the frontal portion of the nozzle spout S, as previously explained. But, in order to provide a more precise control for the functioning of the nozzle, and its continuing dispensing, through the operations of the attitude control device of this invention, in this particular instance, the cylinder 9 is angulated upwardly, somewhere to a degree between approximately 0 through 5 degrees up to 25 degrees, or perhaps even more, but generally in the range of 15 degrees, with the axis of the chamber 3, so that any tilt of the nozzle above the horizontal as when it is being removed from a gasoline tank, and then to be replaced back into the pump housing, will effect an immediate shut-off and a discontinue the operations of the dispensing nozzle. Any turn of the nozzle downwardly, as when it is being used by a subsequent customer for insertion into the automobile or other vehicle gasoline tank, to attain some dispensing of fuel, dislocates the ball valve 11 from upon the valve seat 12, and thereby freely allows the generated vacuum to be vented to the atmosphere, and provides for a continued operation of the fuel dispensing nozzle as desired. But, should the gasoline pump have been previously shut off, but the nozzle not, such as where its holding clip may have retained the handle lever into an opened condition, should the nozzle to be removed from the gasoline pump, and held in the normal hand holding position, when the fuel pump is once again initiated, the unauthorized dispensing of fuel will immediately be curtailed, since the ball valve 11 will be in a position of seating upon its valve seat 12, in order to prevent the venting of any developing vacuum to the atmosphere, which thereby causes a functioning of the previously identified diaphragm for sucumbing to the generated vacuum and effecting an immediate shut off of the internal operating components of the dispensing nozzle.

Thus, safety is built into the dispensing nozzle through the application of the attitude control device of this invention, the device can be regulated for operations depending upon the angle of the tilt given to its cylinder 9 as mounted to its connector means 2, in the manner as previously described.

Figure 8:
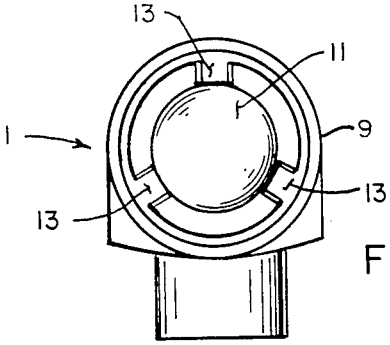
FIG. 8 provides a cross-sectional view of the attitude control device and discloses how means are provided for facilitating the movement of the ball valve therein.

FIG. 8 discloses a cross section of the attitude control device, and more particularly its cylinder 9, of the type that may be embodied within the device as disclosed in FIGS. 4 and 7. As can be seen, the cylinder 9 incorporates a series of integral ribs, as at 13, and the ball valve 11 freely rides thereon in order to facilitate its movement to and forth within the disposed cylinder.

A further desirable feature of this invention is that this particular attitude control device does not require any special machining to the nozzle to allow for its fitting and connection therein, such as must be done with current type control devices used in nozzle presently available upon the market. Since prior art type of devices are not capable of being added to nozzles when they are rebuilt, since they are too large in size, and tend to be too restrictive to the flow of fuel therethrough. This current attitude control device, as disclosed herein, does not add any restriction to the flow of fuel since it replaces an existing tip end of the vent tube T, or they can be added to the nozzle in the field, by simple spout replacement, or when the nozzles are being rebuilt for reusage.

Variations or modifications to the invention disclosed herein, and in particularly to the structure of the attitude control device of this invention, may occur to those skilled in the art upon reviewing the subject matter of this invention. For example, various other angular relationships with respect to the mounting of the cylinder 9 to its connector means 2 may be given consideration by those skilled in the art in light of the disclosure of the structure of this invention made herein, but such variations or modifications, are intended to be encompassed within the scope of any claims to patent protection issuing upon this invention. The description of the preferred embodiment made herein is done so for illustrated purposes only.

Having thus described the invention what is claimed and desired to be secured by Letters Patent is:

1. In the application of an attitude control device to the nozzle spout of a fuel dispensing nozzle, and for use in conjunction with a vent tube of such a spout for such a nozzle and operating to initiate shut-off of the flow of fuel when the nozzle is elevated above a particular degree, but allowing the unrestricted flow of fuel when the dispensing nozzle is being properly applied for said dispensing of fuel, said spout having an opened end for dispensing fuel and said vent tube having an end proximate the spout opened end, the improvement which comprises, an attitude control device operatively associated and communicating with the end of the vent tube for the nozzle and remaining open when the nozzle is normally used for dispensing of fuel as into a fuel tank, said vent tube having an opening normally being opened to atmosphere and exteriorly of the nozzle spout through the operative association of the said attitude control device upon routine dispensing of fuel, and upon elevating of said nozzle spout, said attitude control device closing said vent tube opening to immediately initiate curtailment of the further flow of fuel through the nozzle and out of the end of said spout, said attitude control device incorporating a valve means locating approximately at the end of said spout through which the fuel is discharged, said valve means including a ball valve, said valve means also including a connector applied to the said vent tube, and securing at one end of the vent tube, said connector having a passage therethrough and communicating with the interior of the vent tube, the passage of the connector also opening the interior of the said vent tube to the exterior of the spout at approximately its end, a cylinder mounted upon the connector and extending from an end thereof at approximately that location opposite of where its passage opens into the vent tube, said ball valve provided within said cylinder, whereby the angulation of the nozzle in an approximate downward direction moves the ball valve towards the spout end and to one end of the cylinder and thereby allowing the dispensing of fuel through the nozzle, and the elevating of said nozzle spout allowing the ball valve to move towards the connector passage and seating thereon to close the vent tube and thereby effecting an initiation of means for immediately curtailing the further flow of fuel through the nozzle and spout, and a series of integral and relatively narrow rib means provided upon the interior of the cylinder and with said ball valve riding upon said rib means to facilitate movement of the ball valve along the length of the cylinder between a closing of the vent tube opening, or a movement of the ball valve in an opposite direction for allowing the unrestricted dispensing of fuel through the nozzle and its spout.

2. The invention of claim 1 and wherein said cylinder mounts angularly upon the connector and at a position to prevent dispensing of fuel when the nozzle is elevated above the horizontal, and to allow the dispensing of fuel when the nozzle is lowered below the horizontal.

3. The invention of claim 2 and wherein said connector having a longitudinal axis, and said cylinder being arranged between about five degrees to twenty-five degrees above the axis of the connector.

4. The invention of claim 3 and wherein said cylinder disposed at about fifteen degrees with respect to the axis of the connector.

5. The invention of claim 1 and wherein said connector having a longitudinal axis, and said cylinder being arranged aligned with the axis of the connector.

* * * * *